US009851664B2

(12) United States Patent
Kanematsu et al.

(10) Patent No.: US 9,851,664 B2
(45) Date of Patent: Dec. 26, 2017

(54) FIXING DEVICE

(71) Applicant: KYOCERA Document Solutions Inc., Osaka (JP)

(72) Inventors: Yoshiharu Kanematsu, Osaka (JP); Eriko Hayashi, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/165,444

(22) Filed: May 26, 2016

(65) Prior Publication Data

US 2016/0363893 A1 Dec. 15, 2016

(30) Foreign Application Priority Data

Jun. 12, 2015 (JP) ..... 2015-119348

(51) Int. Cl.
*G03G 15/20* (2006.01)

(52) U.S. Cl.
CPC ..... *G03G 15/2053* (2013.01); *G03G 15/2064* (2013.01); *G03G 2215/00151* (2013.01); *G03G 2215/2061* (2013.01); *G03G 2215/2067* (2013.01)

(58) Field of Classification Search
CPC ..... G03G 15/2053; G03G 15/2064
USPC ..... 399/122, 330
See application file for complete search history.

(56) References Cited

U.S. PATENT DOCUMENTS 5,303,016 A * 4/1994 Oda ..... G03G 15/2064 219/216
2011/0262166 A1* 10/2011 Imamiya ..... G03G 15/2039 399/68

FOREIGN PATENT DOCUMENTS

| | | | |
|---|---|---|---|
| JP | H09-114296 | A | 5/1997 |
| JP | H11-052770 | A | 2/1999 |
| JP | 2000-274426 | A | 10/2000 |
| JP | 2001-312177 | A | 11/2001 |
| JP | 2002-268430 | A | 9/2002 |

* cited by examiner

*Primary Examiner* — David M Gray
*Assistant Examiner* — Andrew V Do
(74) *Attorney, Agent, or Firm* — IP Business Solutions, LLC

(57) ABSTRACT

A fixing device includes a cylindrical heat roller, a heating element, a pressure roller, and an auxiliary roller. The heating element is provided inside the heat roller and configured to apply heat to the heat roller. The pressure roller is configured to be pressed against the heat roller to form, with the heat roller, a nip area where a recording paper sheet is to be nipped. The auxiliary roller is provided inside the heat roller and configured to be pressed toward the pressure roller with a peripheral wall of the heat roller in between. An outer peripheral surface of the auxiliary roller pressed against an inner peripheral surface of the heat roller is formed into an inverted crown shape so that an outside diameter of the auxiliary roller gradually decreases from both axial ends of the auxiliary roller toward an axial center thereof.

3 Claims, 11 Drawing Sheets

FIXING DEVICE

INCORPORATION BY REFERENCE

This application claims priority to Japanese Patent Application No. 2015-119348 filed on Jun. 12, 2015, the entire contents of which are incorporated by reference herein.

BACKGROUND

The present disclosure relates to a fixing device configured to apply heat and pressure to an image formed on a recording paper sheet to fix the image thereon and an image forming apparatus.

Fixing devices are configured to press a heat roller and a pressure roller against each other to form a nip area between them and then nip a recording paper sheet in the nip area with the heat roller heated so that an image (unfixed toner image) on the recording paper sheet is fixed by the application of heat and pressure.

In order to reduce the heating time of the heat roller and save energy in such a fixing device, there is a tendency to reduce the thickness of the peripheral wall of the heat roller to reduce the heat capacity of the heat roller.

However, if the thickness of the peripheral wall of the heat roller is too small, the rigidity of the heat roller becomes low. Thus, the pressure of engagement of the pressure roller against the heat roller may deform the heat roller, in which case an appropriate nip area cannot be ensured. To cope with this, in the case of making the heat roller from aluminum, the peripheral wall of the heat roller is designed to have a thickness of 0.55 mm or more. In the case of making the heat roller from stainless steel, the peripheral wall of the heat roller is designed to have a thickness of 0.3 mm or more. In these manners, the rigidity of the heat roller are ensured.

Alternatively, a member configured to be pressed against the inner peripheral surface of the heat roller may be provided to prevent deformation of the heat roller and ensure a nip area between the heat roller and the pressure roller.

For example, a fixing device is known in which a fixed pad is pressed against the inner peripheral surface of a fixing roller (an equivalent of the heat roller), more specifically against a region thereof corresponding to a nip area, thus preventing deformation of the fixing roller.

Likewise, a fixing device is also known in which a second pressing member is pressed against a region of the inner peripheral surface of a fixing roller corresponding to a nip area to prevent deformation of the fixing roller. Also, there is a fixing device configured to prevent deformation of a heat roller by pressing a pressing member against near a region of the inner peripheral surface of the heat roller corresponding to a nip area.

Furthermore, there is known a fixing device configured to press a metal roller against a region of the inner peripheral surface of a fixing roller corresponding to a nip area. This metal roller is provided to homogenize the temperature distribution of the fixing roller but can also be expected to have the effect of preventing deformation of the fixing roller.

Likewise, there is also known a fixing device configured to press a highly thermally conductive roller against near a region of the inner peripheral surface of a heat roller corresponding to a nip area. This highly thermally conductive roller is also provided to homogenize the temperature distribution of the heat roller but can be expected to have the effect of preventing deformation of the heat roller.

In the case where, as in each of the above fixing devices, deformation of the heat roller is prevented by pressing a member against the inner peripheral surface of the heat roller, the thickness of the peripheral wall of the heat roller can be reduced to 100 μm to 200 μm. In this relation, a 0.55 mm or larger thickness of the aluminum-made heat roller or a 0.3 mm or larger thickness of the stainless steel-made heat roller, which are examples of enough thicknesses of the peripheral wall to ensure the rigidity of these heat rollers, can be achieved by cutting. However, a 100 μm to 200 μm thickness is difficult to achieve by cutting and has to be provided by rolling.

SUMMARY

A technique improved over the aforementioned techniques is proposed as one aspect of the present disclosure.

A fixing device according to an aspect of the present disclosure includes a heat roller, a heating element, a pressure roller, and an auxiliary roller.

The heat roller has a cylindrical shape.

The heating element is provided inside the heat roller and configured to apply heat to the heat roller.

The pressure roller is configured to be pressed against the heat roller to form, with the heat roller, a nip area where a recording paper sheet is to be nipped.

The auxiliary roller is provided inside the heat roller and configured to be pressed toward the pressure roller with a peripheral wall of the heat roller in between.

An outer peripheral surface of the auxiliary roller pressed against an inner peripheral surface of the heat roller is formed into an inverted crown shape so that an outside diameter of the auxiliary roller gradually decreases from both axial ends of the auxiliary roller toward an axial center thereof.

An image forming apparatus according to another aspect of the present disclosure includes the above-described fixing device and an image forming section.

The image forming section is configured to form an image on the recording paper sheet.

The fixing device is configured to nip the recording paper sheet in a nip area between the heat roller and the pressure roller and fix the image on the recording paper sheet by heat and pressure applied from the heat roller and the pressure roller.

DETAILED DESCRIPTION

Hereinafter, a description will be given of embodiments of the present disclosure with reference to the drawings.

First Embodiment

Figure 1:
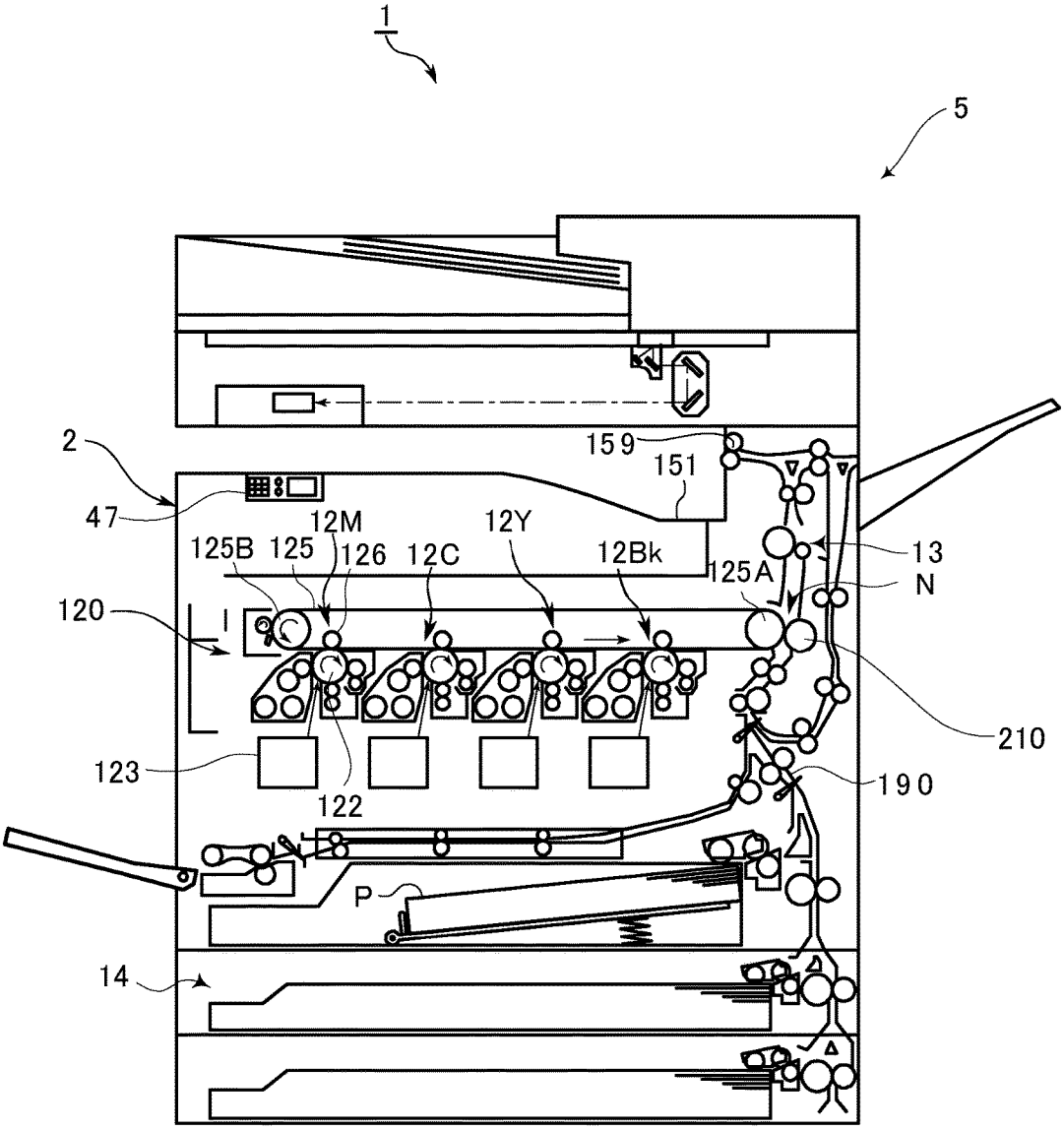
FIG. 1 is a front cross-sectional view showing the structure of an image forming apparatus to which a fixing device according to a first embodiment of the present disclosure is applied.

FIG. 1 is a front cross-sectional view showing the structure of an image forming apparatus to which a fixing device according to a first embodiment of the present disclosure is applied. This image forming apparatus 1 is a multifunction peripheral having a plurality of functions including, for example, a copy function, a print function, a scan function, and a facsimile function. The image forming apparatus 1 is made up so that an apparatus body 2 is provided with an image scanner unit (ISU) 5, an operating section 47, an image forming section 120, a fixing device 13 according to the first embodiment, a sheet feed section 14, and so on.

In performing an image forming operation, the image forming section 120 of the image forming apparatus 1 forms a toner image on a recording paper sheet P serving as a recording medium fed from the sheet feed section 14, based on image data generated by image scanning, image data received from a network-connected computer or a user terminal device, such as a smartphone, image data stored on an internal HDD, or other image data.

Each of image forming units 12M, 12C, 12Y, and 12Bk of the image forming section 120 includes a photosensitive drum 122, a charging device operable to uniformly charge the surface of the photosensitive drum 122, a laser scanning unit (LSU) 123 operable to expose the surface of the photosensitive drum 122 to laser light to form an electrostatic latent image on the surface thereof, a developing device operable to develop the electrostatic latent image on the surface of the photosensitive drum 122 into a toner image, and a primary transfer roller 126.

In performing color printing, the image forming unit 12M for magenta, the image forming unit 12C for cyan, the image forming unit 12Y for yellow, and the image forming unit 12Bk for black in the image forming section 120 uniformly charge the surfaces of their respective photosensitive drums 122, then expose them to laser light to form respective electrostatic latent images corresponding to images of their color components on the surfaces, develop the electrostatic latent images on the surfaces of the photosensitive drums 122 with toners of their color components to form respective toner images on the photosensitive drums 122, and then allow their respective primary transfer rollers 126 to primarily transfer the toner images to an intermediate transfer belt 125 mounted around a drive roller 125A and a driven roller 125B.

The toner images of different color components transferred to the intermediate transfer belt 125 are superposed each other on the intermediate transfer belt 125 by controlling their transfer timings, resulting in a multicolor toner image. A secondary transfer roller 210 is configured to secondarily transfer the multicolor toner image formed on the surface of the intermediate transfer belt 125, at a nip N between the secondary transfer roller 210 and the intermediate transfer belt 125, to a recording paper sheet P conveyed from the sheet feed section 14 along a conveyance path 190.

Thereafter, the fixing device 13 applies heat and pressure to the recording paper sheet P, thus fixing the toner image on the recording paper sheet P by heat and pressure. Then, the recording paper sheet P is discharged through an output roller pair 159 to a sheet output tray 151.

Figure 2:
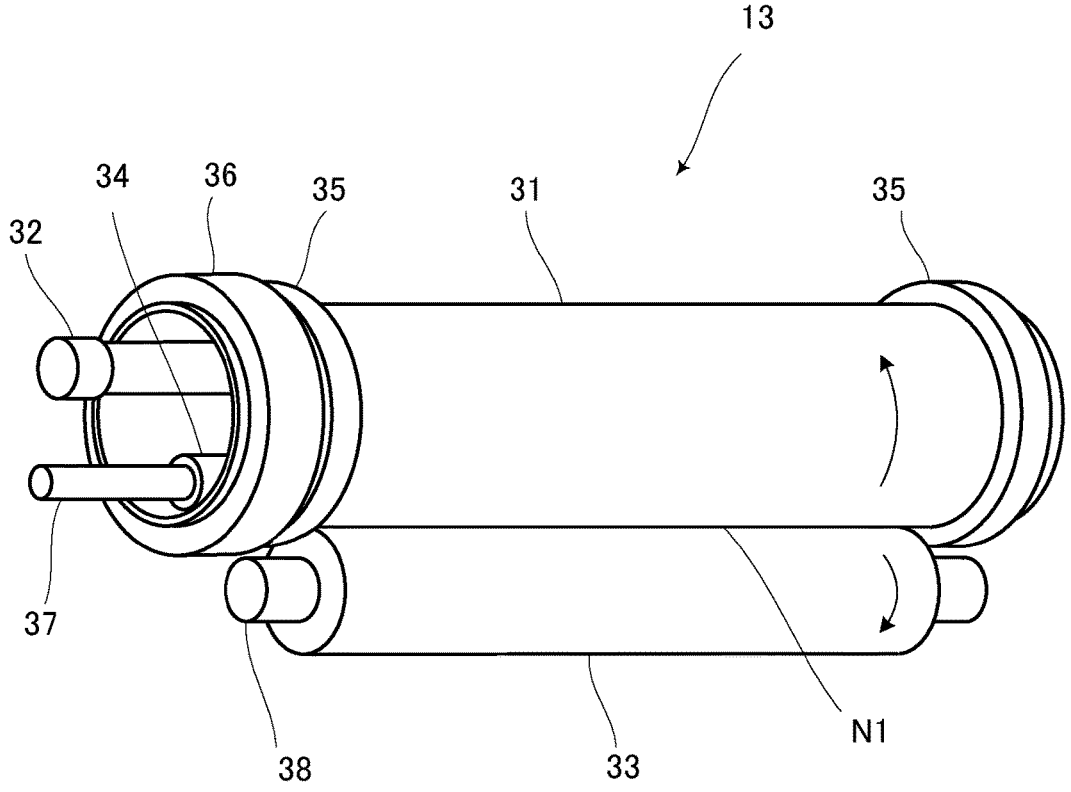
FIG. 2 is a perspective view showing the fixing device according to the first embodiment.

Next, a detailed description will be given of the fixing device 13 according to the first embodiment. FIG. 2 is a perspective view showing the fixing device 13 according to the first embodiment. Furthermore, FIG. 3 is a side view showing the fixing device 13 according to the first embodiment and FIG. 4 is a transverse cross-sectional view showing the fixing device 13 according to the first embodiment.

Figure 3:
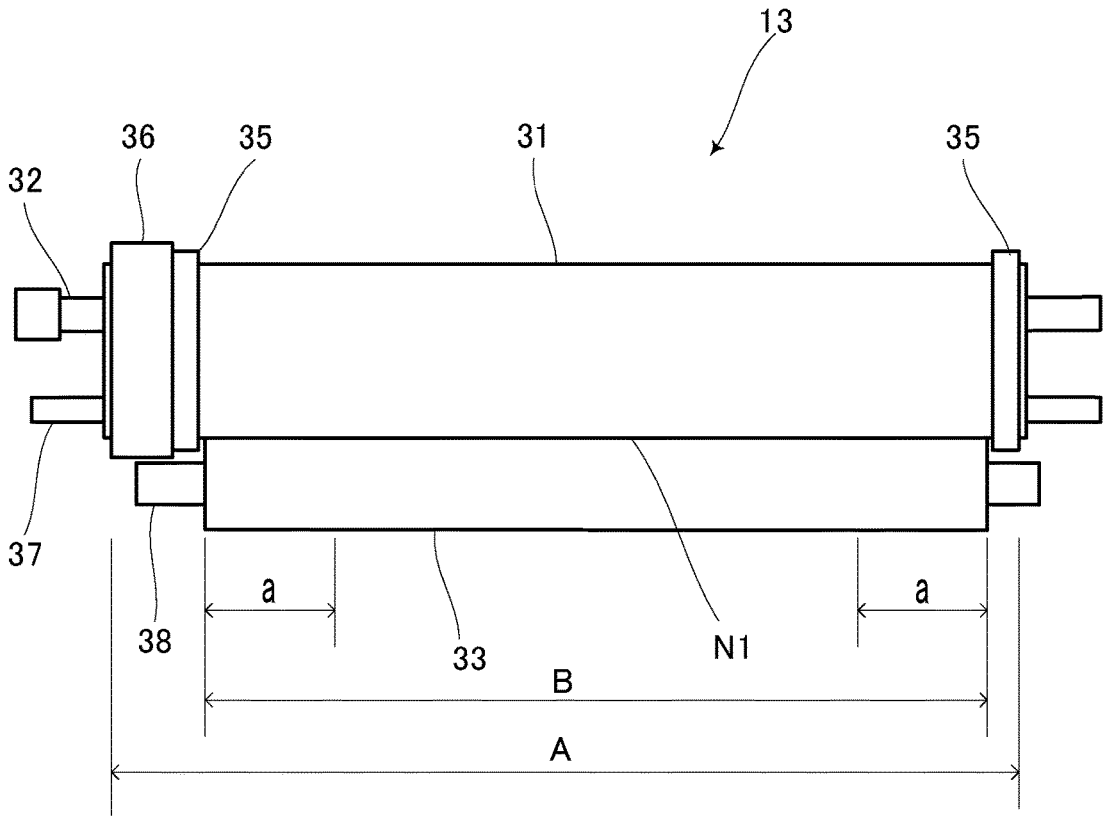
FIG. 3 is a side view showing the fixing device according to the first embodiment.
Figure 4:
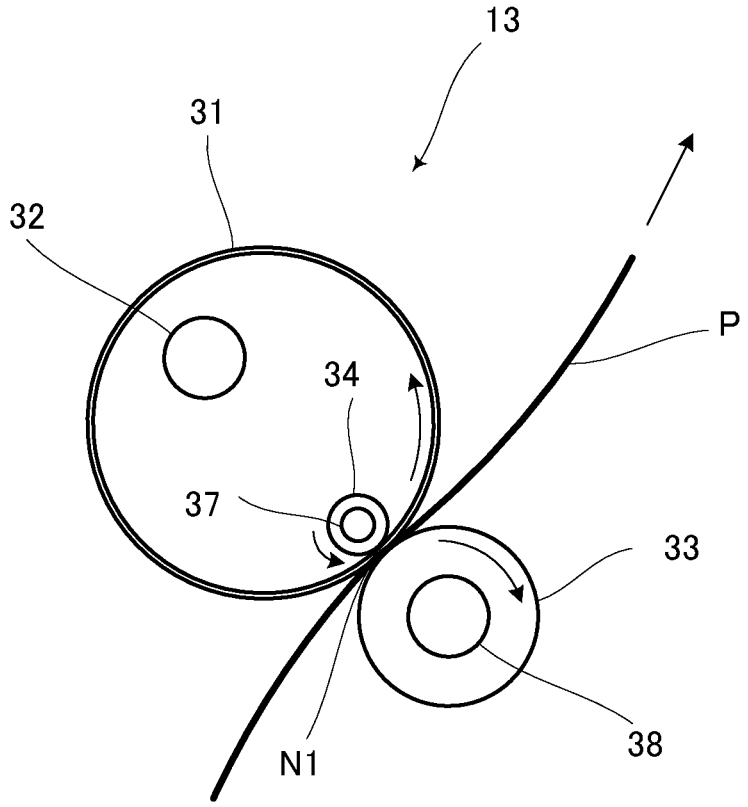
FIG. 4 is a transverse cross-sectional view showing the fixing device according to the first embodiment.

As shown in FIGS. 2 to 4, the fixing device 13 includes a heat roller 31, a heating element 32, a pressure roller 33, an auxiliary roller 34, and so on.

The heat roller 31 has a hollow, cylindrical shape. Both ends of this heat roller 31 are rotatably supported in a pair of bearings 35 fixed to a frame (not shown) of the fixing device 13. Furthermore, a rotating gear 36 is fixed to one end of the heat roller 31. When this rotating gear 36 is meshed with a drive gear (not shown) of the fixing device 13 and rotated, the heat roller 31 is driven into rotation in the direction of the arrow.

The heating element 32 is provided inside the heat roller 31 along the axial direction (longitudinal direction) of the heat roller 31. For example, the heating element 32 is a halogen lamp.

The pressure roller 33 is provided in parallel with the heat roller 31 and pressed against the outer peripheral surface of the heat roller 31 to form a nip area N1 with the heat roller 31. Both ends of a shaft 38 of this pressure roller 33 are rotatably supported in a pair of bearings (not shown) fixed to the frame of the fixing device 13.

The auxiliary roller 34 is provided, inside the heat roller 31, in abutment with the inner peripheral surface of the heat roller 31 and disposed in a region corresponding to the nip area N1. Therefore, the auxiliary roller 34 receives a pressure of engagement from the pressure roller 33 with the peripheral wall of the heat roller 31 in between and is thus pressed against the inner peripheral surface of the heat roller 31. Both ends of a shaft 37 of this auxiliary roller 34 are rotatably supported in a pair of bearings (not shown) fixed to the frame of the fixing device 13.

Each of the outer peripheral surfaces of the heat roller 31, the pressure roller 33, and the auxiliary roller 34 are subjected to an appropriate surface treatment.

When in the fixing device 13 having the above structure the rotating gear 36 of the heat roller 31 is rotated, so that the heat roller 31 is driven into rotation in the direction of the arrow, the pressure roller 33 pressed against the outer peripheral surface of the heat roller 31 follows the rotation of the heat roller 31 to rotate in the direction opposite to the heat roller 31 and the auxiliary roller 34 pressed against the inner peripheral surface of the heat roller 31 follows the rotation of the heat roller 31 to rotate in the same direction as the heat roller 31.

Furthermore, the heating element 32 is configured to, when electric current passes therethrough, generate heat and apply heat directly to the heat roller 31 and the auxiliary roller 34. In addition, the heat roller 31 is indirectly heated by heat conduction from the auxiliary roller 34 to the heat roller 31. Thus, the heat roller 31 is heated to a specified fixing temperature.

When in this state the recording paper sheet P is conveyed to the nip area N1 between the heat roller 31 and the pressure roller 33, heat and pressure are applied to the recording paper sheet P in the nip area N1, so that the toner image on the recording paper sheet P is fixed by heat and pressure.

Figure 5:
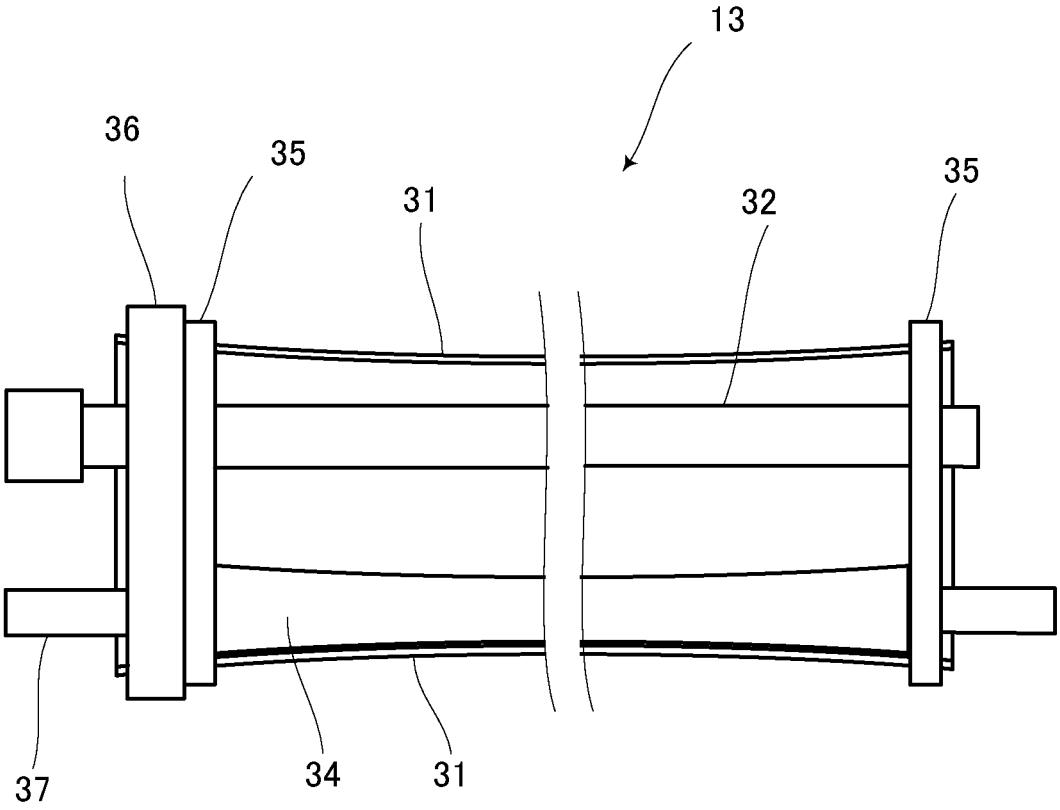
FIG. 5 is a partly cross-sectional view of a heat roller and an auxiliary roller of the fixing device according to the first embodiment as viewed from the side, wherein only the heat roller is shown in broken section.
Figure 6A:
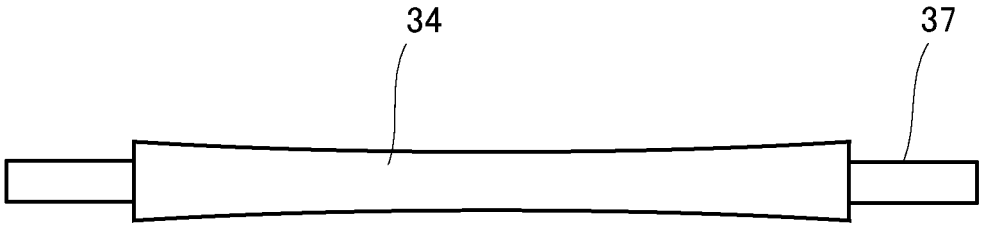
FIG. 6A is a plan view showing an auxiliary roller of the fixing device according to the first embodiment.

Next, a detailed description will be given of the shapes and so on of the heat roller 31, the pressure roller 33, and the auxiliary roller 34. FIG. 5 is a partly cross-sectional view of the heat roller 31 and the auxiliary roller 34 of the fixing device 13 according to the first embodiment as viewed from the side, wherein only the heat roller 31 is shown in broken section. FIG. 6A is a plan view showing the auxiliary roller 34. In FIG. 5, for ease of understanding of the shapes of the outer peripheral surfaces of the heat roller 31 and the auxiliary roller 34, the radii of curvature of these outer peripheral surfaces are shown to be larger than in reality. The same applies to the radius of curvature of the outer peripheral surface of the auxiliary roller 34 in FIG. 6A.

As shown in FIG. 5, the outer peripheral surface of the heat roller 31 has an inverted crown shape so that the outside diameter thereof gradually decreases from both axial (longitudinal) ends of the heat roller 31 toward an axial center thereof.

Unlike the above, the pressure roller has a straight cylindrical shape so that its outside diameter is constant from one end to the other end of the pressure roller 33.

Therefore, the pressure of engagement of the pressure roller 33 against the heat roller 31 is larger in regions a (see FIG. 3) located at both ends of the rollers than in the other regions. Thus, the recording paper sheet P can be promptly passed through the nip area N1 between the heat roller 31 and the pressure roller 33 without getting wrinkles or the like.

On the other hand, the heat roller 31 is made by forming a metal by rolling, as represented by spindle working, wherein the peripheral wall of the heat roller 31 is designed to have a thickness of 100 μm to 200 μm. Thus, the heat capacity of the heat roller 31 can be reduced, achieving a reduced heating time of the heat roller 31 and saved energy.

However, since as just described the peripheral wall of the heat roller 31 is designed to have a thickness of 100 μm to 200 μm, further reduction in thickness of the central portion of the peripheral wall of the heat roller 31 makes it difficult to ensure a required rigidity of the heat roller 31. For this reason, the peripheral wall of the heat roller 31 is designed to have a constant thickness from one end to the other end of the heat roller 31 in the axial (longitudinal) direction. Therefore, in conformity to the inverted crown-shaped outer peripheral surface of the heat roller 31, the inner peripheral surface of the heat roller 31 has a crown shape as viewed from the inside of the heat roller 31 so that the inside diameter of the heat roller 31 gradually decreases from both axial (longitudinal) ends of the heat roller 31 toward the axial center thereof.

The outer peripheral surface of the auxiliary roller 34 pressed against the inner peripheral surface of the heat roller 31 is formed into an inverted crown shape so that the outside diameter of the auxiliary roller 34 gradually decreases from both axial ends of the auxiliary roller 34 toward the axial center thereof.

In this case, as shown in FIG. 5, the shapes of the outer peripheral surface of the auxiliary roller 34 and the inner peripheral surface of the heat roller 31 are designed so that the inverted crown shape of the outer peripheral surface of the auxiliary roller 34 and the crown shape of the inner peripheral surface of the heat roller 31 (as viewed from the inside of the heat roller 31) conform and fit to each other. Therefore, when the auxiliary roller 34 is pressed against the inner peripheral surface of the heat roller 31, the inverted crown shape of the outer peripheral surface of the auxiliary roller 34 fits closely to the crown shape of the inner peripheral surface of the heat roller 31, so that the outer peripheral surface of the auxiliary roller 34 is pressed uniformly against the inner peripheral surface of the heat roller 31. Hence, even if the auxiliary roller 34 is pressed toward the pressure roller 33 with the peripheral wall of the heat roller 31 in between, the central portion of the peripheral wall of the heat roller 31 can be prevented from being pushed outward, so that the inverted crown shape of the outer peripheral surface of the heat roller 31 can be maintained. Thus, the above sheet passage effect can be maintained of promptly passing the recording paper sheet P through the nip area N1 without causing wrinkles or the like in the recording paper sheet P.

Furthermore, as shown in FIG. 3, the length A of an engagement region within which the auxiliary roller 34 is pressed against the inner peripheral surface of the heat roller 31 and which extends along the axial direction of the auxiliary roller 34 is designed to be longer than the length B of an engagement region within which the pressure roller 33 is pressed against the outer peripheral surface of the heat roller 31 and which extends along the axial direction of the auxiliary roller 34. Therefore, in the engagement region of a length B receiving a pressure of engagement from the pressure roller 33, the outer peripheral surface of the auxiliary roller 34 certainly fits to the inner peripheral surface of the heat roller 31, so that the heat roller 31 can be certainly prevented from being deformed.

Furthermore, the auxiliary roller 34 is made of a highly thermally conductive material, for example, a metal material such as aluminum or stainless steel. Therefore, by heat conduction from the auxiliary roller 34 to the heat roller 31, the heat roller 31 can be effectively and uniformly heated to homogenize the temperature distribution on the surface of the heat roller 31. Thus, the toner image on the recording paper sheet P can be fixed well.

As thus far described, in the first embodiment, the peripheral wall of the heat roller 31 is designed to have a thickness of 100 μm to 200 μm, so that the inverted crown-shaped outer peripheral surface of the auxiliary roller 34 can receive a pressure of engagement from the pressure roller 33 with the peripheral wall of the heat roller 31 in between while a reduced heating time of the heat roller 31 and saved energy are achieved. Therefore, a nip area N1 can be formed between the heat roller 31 and the pressure roller 33 while the outer peripheral surface of the heat roller 31 maintains an inverted crown shape, so that the sheet passage effect can be maintained of promptly passing the recording paper sheet P through the nip area N1. Furthermore, the auxiliary roller 34 can homogenize the temperature distribution on the surface of the heat roller 31, so that the toner image on the recording paper sheet P can be fixed well.

For example, in the fixing device shown in BACKGROUND in which the fixed pad pressed against the inner peripheral surface of the heat roller has a curved shape so that its central portion rises toward the pressure roller, thus preventing the central portion of the heat roller 31 from being depressed, the raised central portion of the fixed pad strongly presses against the central portion of the inner peripheral surface of the heat roller. Thus, the central portion of the heat roller is pushed outward, so that the inverted crown shape of the outer peripheral surface of the heat roller is eliminated, which presents a problem with the passage of the recording paper sheet.

On the other hand, in the other fixing devices shown in BACKGROUND, the member pressed against the inner peripheral surface of the heat roller extends linearly in the axial direction of the heat roller. Furthermore, in the case of producing the heat roller by cutting as described previously, the central portion of the heat roller is deeply cut to form the outer peripheral surface of the heat roller into an inverted crown shape. In this case, the heat roller has a constant inside diameter so that the inner peripheral surface of the heat roller extends linearly in the axial direction of the heat roller. Therefore, so long as the member extending linearly in the axial direction of the heat roller is pressed against the inner peripheral surface of the heat roller, the inverted crown shape of the outer peripheral surface of the heat roller is not eliminated, which does not present the problem with the passage of the recording paper sheet.

However, in the case of reducing the thickness of the peripheral wall of the heat roller to 100 μm to 200 μm by rolling as described above, the central portion of the peripheral wall cannot be reduced in thickness because the heat roller must ensure rigidity required as a roller. In this case, the thickness of the peripheral wall of the heat roller can only be made constant. Therefore, when the outer peripheral surface of the heat roller is formed into an inverted crown shape, the inside diameter of the heat roller cannot be made constant and the inner peripheral surface of the heat roller has a crown shape in which the inside diameter thereof gradually decreases from both axial ends thereof toward the axial center thereof.

Thus, when the member extending linearly in the axial direction of the heat roller is pressed against the inner peripheral surface of the heat roller, the central portion of the inner peripheral surface of the heat roller is strongly pushed outward. Also in this case, the inverted crown shape of the outer peripheral surface of the heat roller is eliminated, which presents a problem with the passage of the recording paper sheet.

In contrast, in accordance with this embodiment, the heat roller 31 can be prevented from being deformed while the thickness of the peripheral wall of the heat roller 31 can be reduced.

Modification 1

Figure 7:
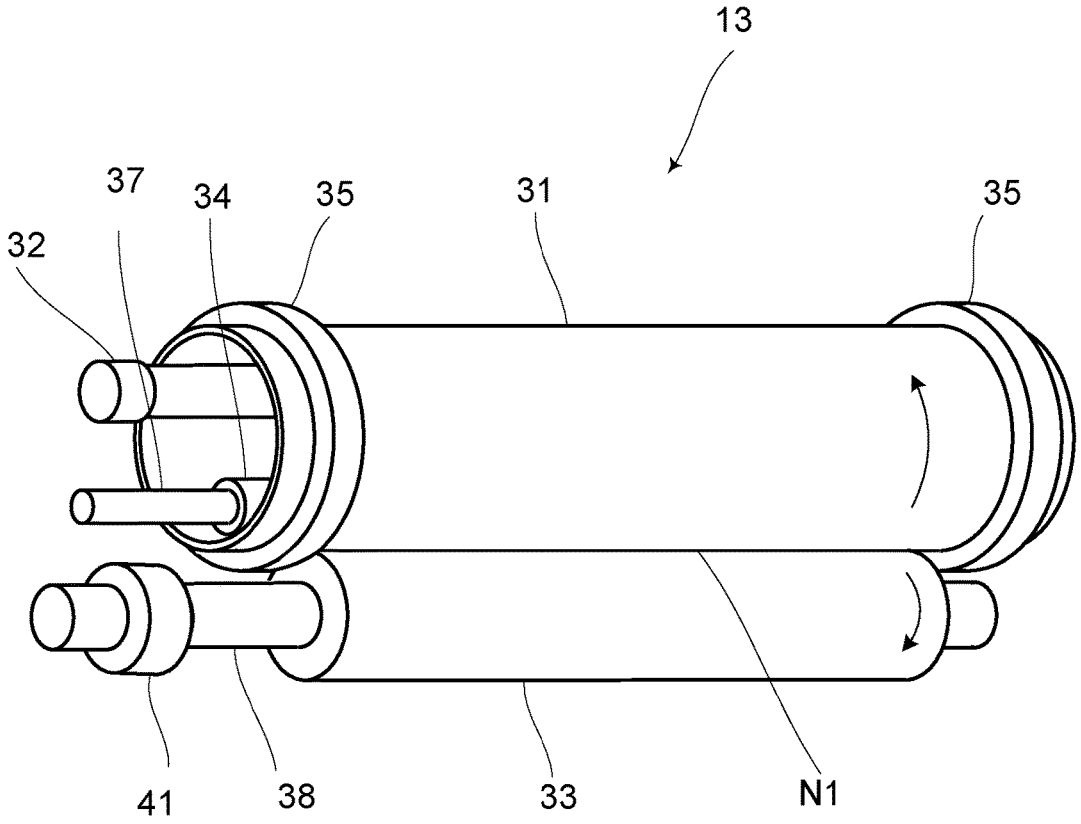
FIG. 7 is a perspective view showing a modification of the fixing device according to the first embodiment.

FIG. 7 is a perspective view showing Modification 1 of the fixing device 13 according to the first embodiment. The fixing device 13 of Modification 1 is different from the first embodiment in that the rotating gear 36 at one end of the heat roller 31 is eliminated and a rotating gear 41 is provided instead at one end of the shaft 38 of the pressure roller 33, and the other structures thereof are the same as in the first embodiment.

The rotating gear 41 can be rotated in meshing engagement with a drive gear (not shown) of the fixing device 13, so that the pressure roller 33 is driven into rotation in the direction of the arrow. With this rotation, the heat roller 31 pressed against the outer peripheral surface of the pressure roller 33 follows the rotation of the pressure roller 33 to rotate in the reverse direction and the auxiliary roller 34 pressed against the inner peripheral surface of the heat roller 31 follows the rotation of the heat roller 31 to rotate in the same direction as the heat roller 31.

Furthermore, the heat roller 31 and the auxiliary roller 34 are heated by the heating element 32. When in this state the recording paper sheet P is conveyed to the nip area N1 between the heat roller 31 and the pressure roller 33 and nipped in the nip area N1, the toner image on the recording paper sheet P is fixed by the application of heat and pressure.

Figure 6B:
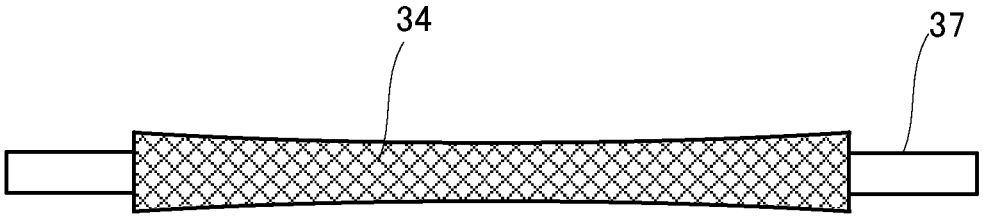
FIGS. 6B and 6C are plan views showing modifications of the auxiliary roller.
Figure 6C:
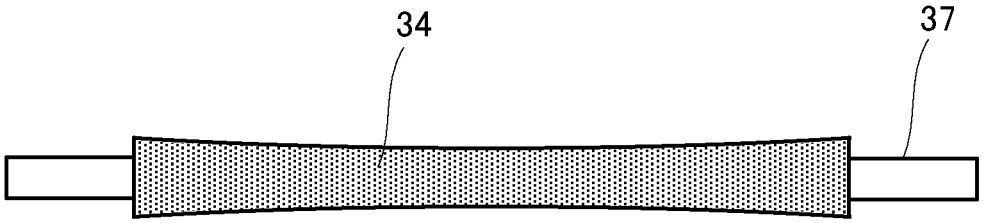

FIGS. 6B and 6C show other modifications of the auxiliary roller 34. Like FIG. 6A, also in FIGS. 6B and 6C, for ease of understanding of the shape of the outer peripheral surface of the auxiliary roller 34, the radius of curvature of the outer peripheral surface is shown to be larger than in reality.

The auxiliary roller 34 in this modification is made of a metal material, such as aluminum or stainless steel and smooth asperities, i.e., asperities of irregularities, are formed on the outer peripheral surface thereof. For example, reticular shallow grooves are formed in the outer peripheral surface of the auxiliary roller 34 as shown in FIG. 6B or the outer peripheral surface of the auxiliary roller 34 is roughened as shown in FIG. 6C. Thus, the frictional resistance of the outer peripheral surface of the auxiliary roller 34 to the inner peripheral surface of the heat roller 31 is increased, so that the auxiliary roller 34 can certainly follow the rotation of the heat roller 31 to rotate. Furthermore, since the asperities formed on the outer peripheral surface of the auxiliary roller 34 are smooth, it can be avoided that the inner peripheral surface of the heat roller 31 is damaged by contact with the outer peripheral surface of the auxiliary roller 34.

The outer peripheral surface of the auxiliary roller 34 is more preferably subjected to a black surface treatment. Examples of the surface treatment include a surface treatment using a heat-resistant resin and a surface treatment using an inorganic mineral. Thus, the auxiliary roller 34 can efficiently absorb heat from the heating element 32, such as a halogen lamp, and, in addition, the heat conduction from the auxiliary roller 34 to the heat roller 31 can more effectively and uniformly heat the heat roller 31.

Second Embodiment

Figure 8:
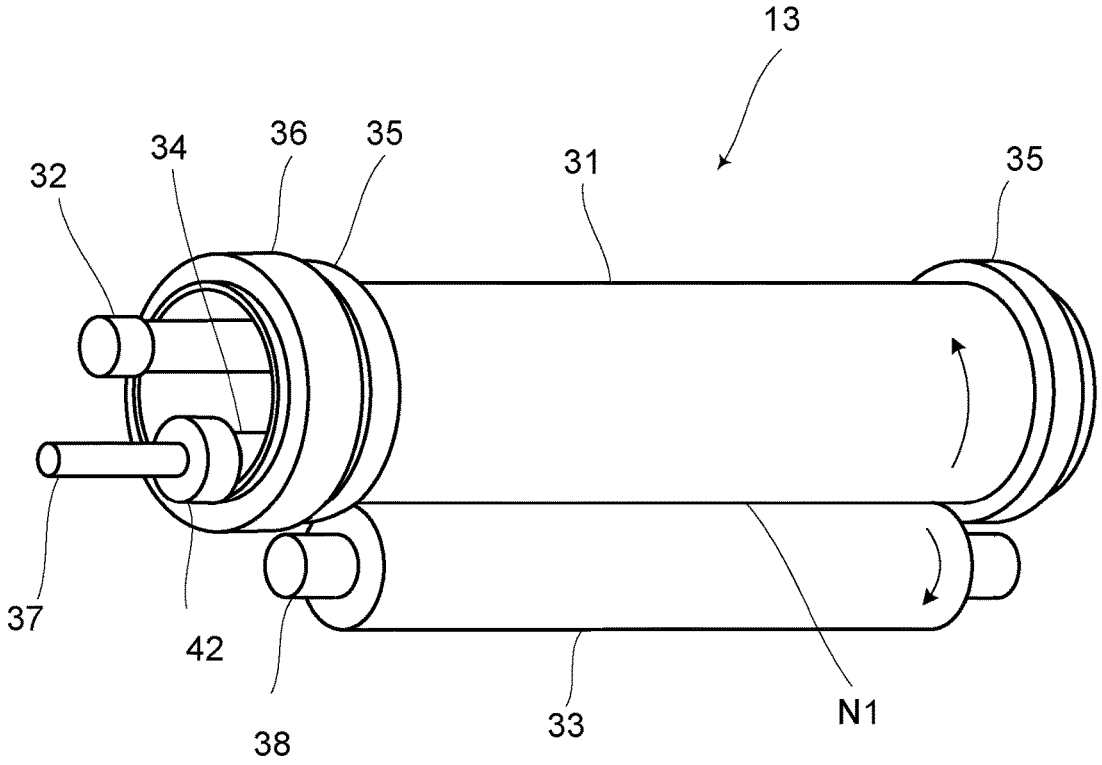
FIG. 8 is a perspective view showing a fixing device according to a second embodiment.
Figure 9:
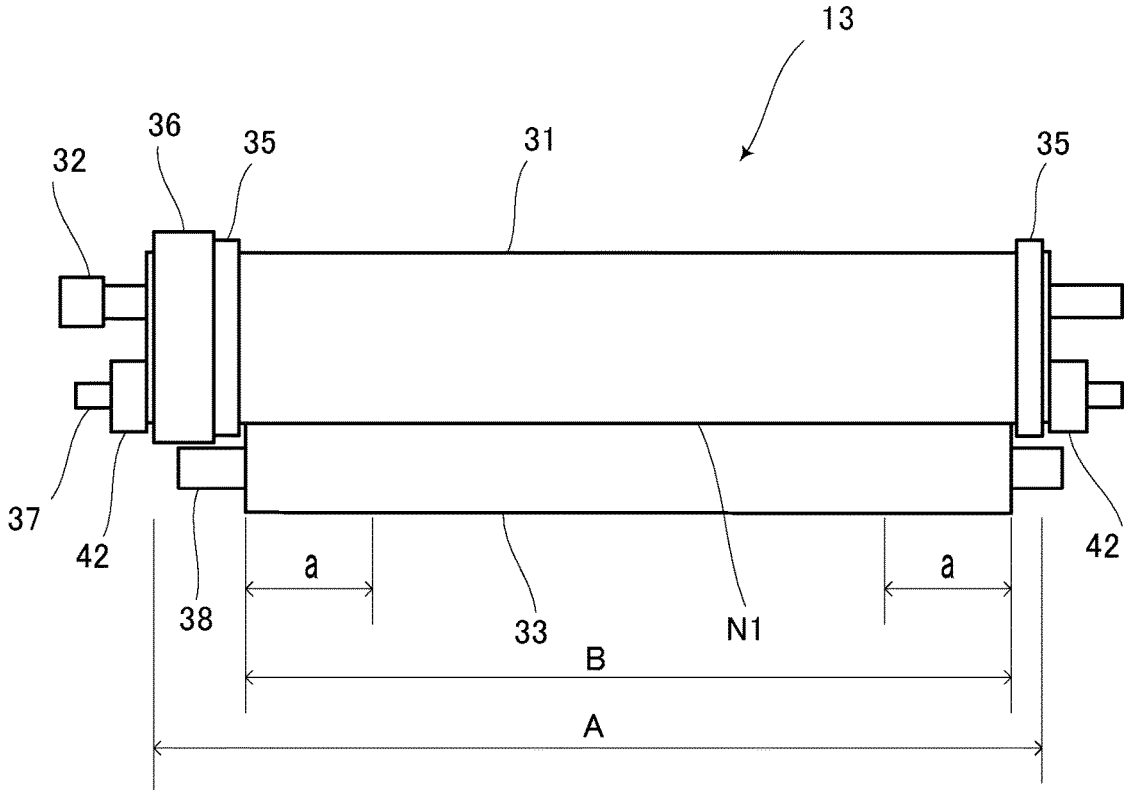
FIG. 9 is a side view showing the fixing device according to the second embodiment.
Figure 10A:
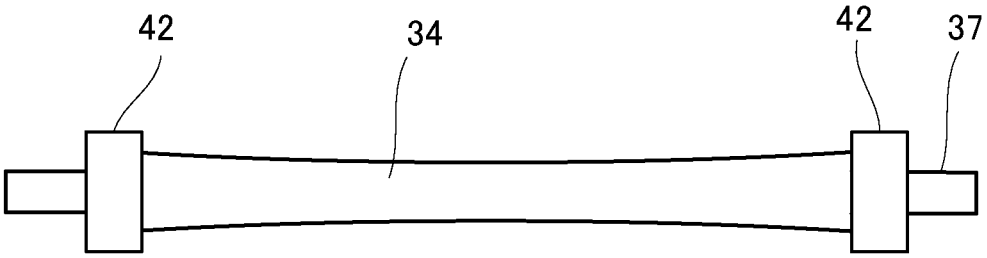
FIG. 10A is a plan view showing an auxiliary roller of the fixing device according to the second embodiment.

Next, a detailed description will be given of a fixing device 13 according to a second embodiment. FIG. 8 is a perspective view showing the fixing device 13 according to the second embodiment. FIG. 9 is a side view showing the fixing device 13 according to the second embodiment. FIG. 10A is a plan view showing an auxiliary roller 34 of the fixing device 13 according to the second embodiment. In FIG. 10A, for ease of understanding of the shape of the outer peripheral surface of the auxiliary roller 34, the radius of curvature of the outer peripheral surface is shown to be larger than in reality.

The fixing device 13 according to the second embodiment is different from the first embodiment in that a shaft 37 of the auxiliary roller 34 is additionally provided at both end portions with their respective position restricting members 42, and the other structures thereof are the same as in the first embodiment.

The position restricting members 42 are flange-shaped members provided at both the end portions of the shaft 37 of the auxiliary roller 34 which extend outwardly of both ends of the heat roller 31 and they face and come close to or in contact with both the ends of the heat roller 31.

In this structure, when the position of the heat roller 31 comes nearly to deviate in the axial direction of the heat roller 31, either one of the position restricting members 42 of the auxiliary roller 34 abuts on the adjacent end of the heat roller 31, so that the deviation of the heat roller 31 can be prevented.

Therefore, the nip area N1 between the heat roller 31 and the pressure roller 33 can be appropriately held and the inverted crown shape of the outer peripheral surface of the heat roller 31 can be maintained, so that the sheet passage effect can be maintained of promptly passing the recording paper sheet P through the nip area N1.

Furthermore, since the auxiliary roller 34 and the position restricting members 42 rotate in the same direction as the heat roller 31, the frictional resistance of the position restricting members 42 to both the ends of the heat roller 31 is small. Therefore, it can be avoided that both the ends of the heat roller 31 are worn or damaged by contact with the position restricting members 42 of the auxiliary roller 34 to reduce the life of the heat roller 31.

In the case where, as in this structure, the auxiliary roller 34 and the heating element 32 are disposed inside the heat roller 31, the space for placement of the auxiliary roller 34 becomes narrow and, therefore, the outside diameter of the auxiliary roller 34 needs to be, for example, about 10 mm. Therefore, the shaft 37 of the auxiliary roller 34 comes very close to the edges of the heat roller 31 so that there is almost no space between the shaft 37 of the auxiliary roller 34 and both the ends of the heat roller 31. Hence, the heat roller 31 cannot be provided at both the ends with stop rings for preventing axial deviation of the heat roller 31.

In the second embodiment, however, the position restricting members 42 of the auxiliary roller 34 function as the above stop rings. Therefore, there is no need to provide the stop rings.

Furthermore, if the position restricting members 42 were configured not to rotate, the frictional resistance of the position restricting members 42 to both the ends of the heat roller 31 might be large. In addition, because the peripheral wall of the heat roller 31 is thin and the pressure per unit area on both the ends of the heat roller 31 from the position restricting members 42 is high, both the ends of the heat roller 31 would be easily worn or damaged to reduce the life of the heat roller 31. Alternatively, if the position restricting members 42 that may abut on both the ends of the heat roller 31 are made of a soft material, such as resin, it may be possible to prevent wear or damage of both the ends of the heat roller 31. In this case, however, the life of the position restricting members 42 will be reduced.

Unlike the above, since in the second embodiment the auxiliary roller 34 and the position restricting members 42 rotate in the same direction as the heat roller 31, it can be avoided that the life of the heat roller 31 or the position restricting members 42 is reduced in the above manner.

Specifically, although the placement of the auxiliary roller 34 inside of the heat roller 31 makes it impossible to provide stop rings at both the ends of the heat roller 31, the alternative provision of the position restricting members 42 on both the end portions of the shaft 37 of the auxiliary roller 34 makes it possible to prevent axial deviation of the heat roller 31. In addition, since the auxiliary roller 34 and the position restricting members 42 rotate in the same direction as the heat roller 31, it can be avoided that the lives of the heat roller 31 and the position restricting members 42 are reduced.

Modification 2

Figure 11:
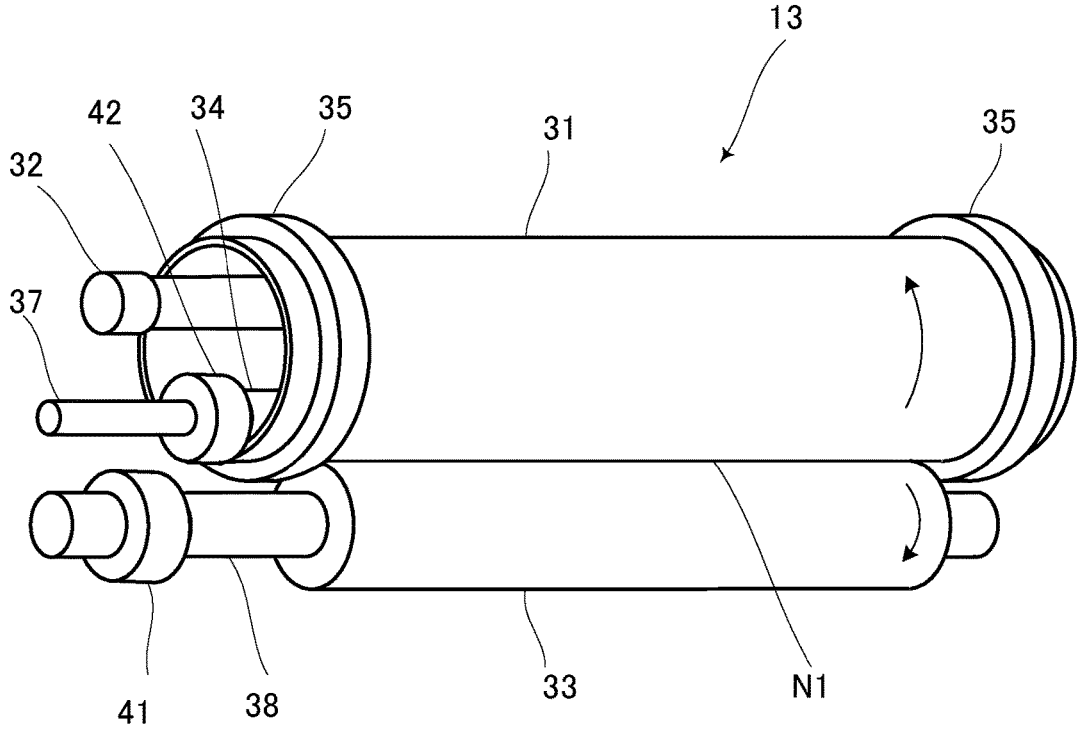
FIG. 11 is a perspective view showing a modification of the fixing device according to the second embodiment.

FIG. 11 is a perspective view showing Modification 2 of the fixing device 13 according to the second embodiment. The fixing device 13 of Modification 2 is different from the second embodiment in that the rotating gear 36 at one end of the heat roller 31 is eliminated and a rotating gear 41 is provided instead at one end of the shaft 38 of the pressure roller 33, and the other structures thereof are the same as in the second embodiment.

The rotating gear 41 can be rotated in meshing engagement with a drive gear (not shown) of the fixing device 13, so that the pressure roller 33 is driven into rotation in the direction of the arrow. With this rotation, the heat roller 31 follows the rotation of the pressure roller 33 to rotate in the reverse direction and the auxiliary roller 34 pressed against the inner peripheral surface of the heat roller 31 follows the rotation of the heat roller 31 to rotate in the same direction as the heat roller 31.

When the recording paper sheet P is conveyed to the nip area N1 between the heat roller 31 and the pressure roller 33 and nipped in the nip area N1 while the heat roller 31 and the auxiliary roller 34 are heated by the heating element 32, the toner image on the recording paper sheet P is fixed by the application of heat and pressure.

Figure 10B:
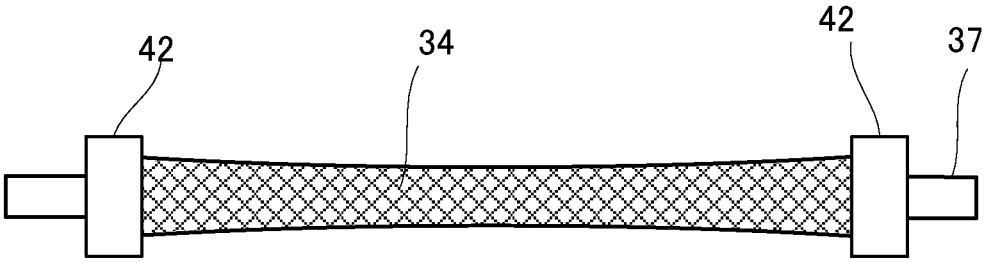
FIGS. 10B and 10C are plan views showing modifications of the auxiliary roller.
Figure 10C:
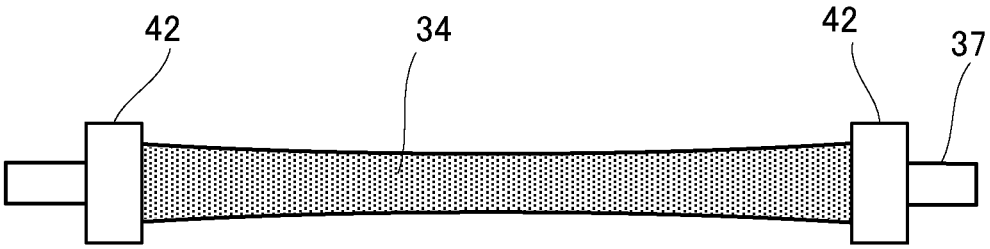

FIGS. 10B and 10C show other modifications of the auxiliary roller 34. Like FIG. 10A, also in FIGS. 10B and 10C, the radius of curvature of the outer peripheral surface of the auxiliary roller 34 is shown to be larger than in reality.

The auxiliary roller 34 in this modification is a roller made of a metal material, such as aluminum or stainless steel, and having an outer peripheral surface formed of smooth asperities, for example, by forming reticular shallow grooves in the outer peripheral surface or roughening the outer peripheral surface. Therefore, the frictional resistance of the outer peripheral surface of the auxiliary roller 34 to the inner peripheral surface of the heat roller 31 is increased, so that the auxiliary roller 34 can certainly follow the rotation of the heat roller 31 to rotate.

Furthermore, the outer peripheral surface of the auxiliary roller 34 is subjected to a black surface treatment using a heat-resistant resin or an inorganic mineral. Thus, the auxiliary roller 34 can efficiently absorb heat from the heating element 32, such as a halogen lamp, and, in addition, the heat conduction from the auxiliary roller 34 to the heat roller 31 can more effectively and uniformly heat the heat roller 31.

Although the description of the above embodiments is given taking a color printer as an example of the image forming apparatus according to the present disclosure, the example is merely illustrative and the image forming apparatus may be any other image forming apparatus, including a black-and-white printer and other electronic devices, such as a multifunction peripheral, a copier, and a facsimile machine.

The structures and processing described with reference to FIGS. 1 to 11 are merely illustrative of the present disclosure and the present disclosure is not intended to be limited to the above structures and processing.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A fixing device comprising:

a heat roller having a cylindrical shape;

a heating element provided inside the heat roller and configured to apply heat to the heat roller;

a pressure roller configured to be pressed against the heat roller to form, with the heat roller, a nip area where a recording paper sheet is to be nipped; and an auxiliary roller provided inside the heat roller and configured to be pressed toward the pressure roller with a peripheral wall of the heat roller in between, wherein an outer peripheral surface of the auxiliary roller pressed against an inner peripheral surface of the heat roller is formed into an inverted crown shape so that an outside diameter of the auxiliary roller gradually decreases from both axial ends of the auxiliary roller toward an axial center thereof, an outer peripheral surface of the heat roller against which the pressure roller is pressed is formed into an inverted crown shape so that an outside diameter of the heat roller gradually decreases from both axial ends of the heat roller toward an axial center thereof, the shape of the outer peripheral surface of the auxiliary roller and the shape of the inner peripheral surface of the heat roller conform and fit to each other, and asperities formed of irregularities are formed on the outer peripheral surface of the auxiliary roller.

2. A fixing device comprising:

a heat roller having a cylindrical shape;

a heating element provided inside the heat roller and configured to apply heat to the heat roller;

a pressure roller configured to be pressed against the heat roller to form, with the heat roller, a nip area where a recording paper sheet is to be nipped; and an auxiliary roller provided inside the heat roller and configured to be pressed toward the pressure roller with a peripheral wall of the heat roller in between, wherein an outer peripheral surface of the auxiliary roller pressed against an inner peripheral surface of the heat roller is formed into an inverted crown shape so that an outside diameter of the auxiliary roller gradually decreases from both axial ends of the auxiliary roller toward an axial center thereof, an outer peripheral surface of the heat roller against which the pressure roller is pressed is formed into an inverted crown shape so that an outside diameter of the heat roller gradually decreases from both axial ends of the heat roller toward an axial center thereof, the shape of the outer peripheral surface of the auxiliary roller and the shape of the inner peripheral surface of the heat roller conform and fit to each other, and the auxiliary roller is made of a metal material and the outer peripheral surface of the auxiliary roller is subjected to a black surface treatment.

3. The fixing device according to claim 2, wherein the surface treatment is a surface treatment using a heat-resistant resin or an inorganic mineral.

* * * * *